US006601831B2

(12) United States Patent
Erwin

(10) Patent No.: US 6,601,831 B2
(45) Date of Patent: Aug. 5, 2003

(54) MODULAR FENCE SYSTEM

(75) Inventor: Ronald D. Erwin, Fayetteville, GA (US)

(73) Assignee: Erwin Industries, Inc., Peachtree City, GA (US)

( * ) Notice: Subject to any disclaimer, the term of this patent is extended or adjusted under 35 U.S.C. 154(b) by 0 days.

(21) Appl. No.: 09/859,013

(22) Filed: May 15, 2001

(65) Prior Publication Data

US 2002/0121634 A1 Sep. 5, 2002

Related U.S. Application Data

(60) Provisional application No. 60/273,508, filed on Mar. 5, 2001, and provisional application No. 60/273,375, filed on Mar. 5, 2001.

(51) Int. Cl.[7] ..... E04H 17/14

(52) U.S. Cl. ..... 256/65.05; 256/19; 256/59; 256/24

(58) Field of Search ..... 256/65.01–65.06, 256/73, 24, 27, 60, 19, 59

(56) References Cited

U.S. PATENT DOCUMENTS

| | | | | |
|---|---|---|---|---|
| 2,608,386 A | | 8/1952 | Hart | |
| 2,666,238 A | | 1/1954 | Hagedorn | |
| 3,134,566 A | | 5/1964 | Beene, III | |
| 3,136,530 A | | 6/1964 | Case | |
| 3,615,110 A | | 10/1971 | Fugate | |
| 4,114,861 A | | 9/1978 | Long | |
| 4,226,393 A | | 10/1980 | Rardin et al. | |
| 4,272,060 A | * | 6/1981 | Stafford | 256/24 |
| 4,280,686 A | | 7/1981 | Wack | |
| 4,369,953 A | * | 1/1983 | Greiner et al. | 256/24 |
| 4,667,935 A | | 5/1987 | Moore | |
| 5,029,820 A | | 7/1991 | Katz | |
| 5,100,107 A | | 3/1992 | Latta | |
| 5,121,891 A | | 6/1992 | Goldsmith | |
| 5,186,571 A | | 2/1993 | Hentzschel | |
| 5,215,290 A | * | 6/1993 | Khalessi | 256/19 |
| 5,238,321 A | | 8/1993 | Jarjoura | |
| 5,547,169 A | | 8/1996 | Russell | |
| 5,603,580 A | | 2/1997 | Leek et al. | |
| 5,645,270 A | | 7/1997 | Lawrence | |
| 5,702,090 A | * | 12/1997 | Edgman | 256/19 |
| 5,755,431 A | | 5/1998 | Williams | |
| 5,788,224 A | | 8/1998 | Platt | |
| 5,873,671 A | | 2/1999 | West | |
| 5,938,184 A | | 8/1999 | DeSouza | |
| 5,967,498 A | | 10/1999 | Junell | |
| 6,017,019 A | | 1/2000 | Erwin | |
| 6,053,481 A | | 4/2000 | Scheide | |
| D436,836 S | * | 1/2001 | Erwin | D8/354 |
| 6,173,944 B1 | | 1/2001 | McCarthy | |
| D437,772 S | * | 2/2001 | Erwin | D8/354 |
| 6,260,828 B1 | | 7/2001 | English | |
| 6,345,809 B1 | * | 2/2002 | Bebendorf | 256/24 |

FOREIGN PATENT DOCUMENTS

| | | |
|---|---|---|
| GB | 20230 | of 1899 |
| GB | 435226 | 9/1935 |

* cited by examiner

*Primary Examiner*—Lynne H. Browne
*Assistant Examiner*—Aaron M Dunwoody
(74) *Attorney, Agent, or Firm*—Gardner Groff, P.C.

(57) ABSTRACT

A plastic modular fence system having posts, a first rail, a second rail, and upright picket boards extending between the rails. A plurality of mounting brackets each have a T-shaped opening for receiving an end of one of the rails therein and an edge of a picket therein. The bracket opening extends through the peripheral wall in places to allow the edge of the picket to extend out of the bracket on opposite sides. Also, the rails have openings configured to receive the generally vertical picket boards when the rails are positioned either horizontally or at an angle to the horizon. For example, the openings in the intermediate rail have a generally trapezoidal shape with one opening end longer than the other opening end.

28 Claims, 11 Drawing Sheets

MODULAR FENCE SYSTEM

CROSS REFERENCE TO RELATED APPLICATIONS

This application claims the priority benefit of U.S. Provisional Application No. 60/273,508 filed Mar. 5, 2001 and U.S. Provisional Application No. 60/273,375, filed Mar. 5, 2001, which are hereby incorporated by reference in its entirety.

TECHNICAL FIELD

The present invention relates generally to railing and fencing and, more specifically, to a modular plastic fence.

BACKGROUND OF THE INVENTION

Outdoor decks are extremely popular in residential home construction. Homes and apartments, as well as a variety of other buildings, often incorporate exterior decks into their design. These decks provide convenient spaces for a variety of outdoor activities, including cookouts, dining and sunbathing, as well as other leisure activities. Moreover, decks typically are provided with a railing or perimeter fence to keep people from falling over the edge of the deck. Additionally, perimeter and accent fencing is commonly added onto landscapes, creating a boundary for foliage displays and garden areas.

Wood products traditionally have been the primary source of materials for use in decking and fence construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of wood products. With the diminishing availability of timber resources, wood products are becoming increasingly expensive. There is, therefore, a substantial need for long-lasting substitute construction materials that can lessen the need to harvest timber resources.

One potential approach to addressing the above need is to provide substitute fence and decking products made of plastic, rather than wood. Plastic fence products provide a long-lasting alternative to wood. In addition, plastic fence products alleviate the need for costly painting and repainting. A variety of plastic building products are known. For example, U.S. Pat. No. 4,045,603 describes a three-layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits. Such plastic material can be used to create fencing elements.

Plastic fences tend to be inexpensive to manufacture, but often present difficulties in installation. In the known plastic fencing products, it has been difficult to provide "shadow box" fencing (a type of privacy fence having relatively wide picket boards and in which adjacent picket boards are staggered front and back).

Accordingly, a need yet remains in the art for an inexpensive, adaptable privacy fence system that can be easily installed and that is made from a light-weight, weather-resistant material. It is to the provision of such a fence system that the present invention is primarily directed.

SUMMARY OF THE INVENTION

Briefly described, in a first preferred form the present invention both overcomes the above-mentioned disadvantages and meets the recognized need for such a device, by providing a modular fence system. Generally, the present device is a modular fence system including a pair of upright posts, a first upper rail and a second lower rail. The modular fence system also includes a plurality of upright picket boards extending from the second lower rail to the first upper rail, with adjacent ones of the upright picket boards being staggered front and back. The modular fence system also includes a plurality of mounting brackets secured to the posts for receiving and securing end portions of the rails therein, the brackets also being adapted to receive an edge of an upright picket board therein for securing the edge of the upright picket board near an upright post.

Preferably, the modular fence system includes a third intermediate rail positioned between the first upper rail and the second lower rail, the third intermediate rail having two rows of staggered openings formed therethrough for receiving the upright picket boards therethrough. Also preferably, the first upper rail and the second lower rail each have two rows of staggered openings formed therein for receiving upper and lower ends of the upright picket boards therein.

Preferably, the openings in the rails each have a length sufficiently greater than a width of the picket boards such that the picket boards can be received into the rail openings with the rails being disposed either horizontally or at an angle relative to horizontal, and the picket boards maintained generally vertical. In this manner, the fence system can be configured so that all the picket boards are generally vertical and the rails are horizontal or racked at an angle as may be desired to conform to the slope of the ground. Thus, the same rails can be provided for using the fence system on generally flat ground or on sloped ground.

Furthermore, the intermediate rail can have first and second opening ends, for example, with the first opening end through the top portion of the rail and the second opening end through the bottom portion. The second opening end can be longer than the first opening end so that the opening has the general shape of a trapezoid. In this manner, the first end of the opening will fit closely with the picket board extending through the opening to minimize the intrusion of moisture or debris and to provide an aesthetically pleasing, custom-made, close-fitting appearance, while the second opening end permits the rail to be racked at an angle as desired.

Preferably, the modular fence system's mounting brackets on one of the posts are identical to the mounting brackets on the other of the posts, with only the orientation of the brackets differing. Preferably, the modular fence system's upright posts, the rails, the upright picket boards, and the brackets are at least partially made from plastic.

Another aspect of the invention lies in the design of the brackets. According to this aspect of the invention, a bracket is provided for use with a fence or railing having posts, a first rail, a second rail, and upright pickets extending between the rails. The bracket includes a body having peripheral walls defining an opening for receiving an end of one of the rails therein. The opening also is shaped to receive an edge of a picket therein.

Preferably, the peripheral walls of the brackets includes at least two walls that lean toward each other to form an inversely tapered interior to allow the bracket to receive rail ends therein at angles other than 90 degrees. Preferably, the bracket opening defined by the peripheral walls is generally T-shaped. Also, preferably the generally T-shaped opening includes a first generally rectangular opening portion and a second generally rectangular opening portion, with the first generally rectangular opening portion being about twice as wide as the second generally rectangular opening portion. Most preferably, the bracket opening extends through the peripheral wall in places to allow the edge of the picket to extend out of the bracket on opposite sides. It is preferred that the bracket is made from plastic.

Further, preferably, the body includes at least two flanges for securing the body to a post using fasteners. Preferably, the flanges are formed with throughholes to allow the bracket to be secured easily with common fasteners. Alternatively, the bracket can be adhesively affixed to the post.

Accordingly, each bracket can be attached to one of the posts, and each bracket opening can receive and secure the end portions of the rails therein. Additionally, the brackets can also receive and secure the edge of one of the upright picket boards therein. In this manner, the picket boards adjacent the posts can be secured in place near the corresponding upright post, leaving no gap between the picket boards and the posts, or only a very small gap. Because the picket boards are arranged in a shadow box configuration where there does not appear to be a gap between them when viewed from the front or back, the bracket provides a consistent and aesthetic appearance to the fence system. Furthermore, by leaving no or only small gaps, the fence system provides greater privacy.

Moreover, the components of the fence system are preferably provided as a kit ready for assembly into one or more modular fence sections. Also, the kit can be provided with only the rails and brackets for assembly with separately obtained picket boards and posts. Alternatively, the picket boards, posts, rails, and brackets of the fence system can be pre-assembled and provided as ready-to-install units.

These objects, advantages and features of the present invention will become more apparent upon reading the following specification in conjunction with the accompanying drawing figures.

BRIEF DESCRIPTION OF THE DRAWING FIGURES

The present invention will be better understood by reading the Detailed Description of the Preferred Embodiment with reference to the accompanying drawing figures, in which.

DETAILED DESCRIPTION OF THE PREFERRED EMBODIMENT

In describing the preferred and alternate embodiments of the present invention, specific terminology is employed for the sake of clarity. The invention, however, is not intended to be limited to the specific terminology so selected.

Figure 1:
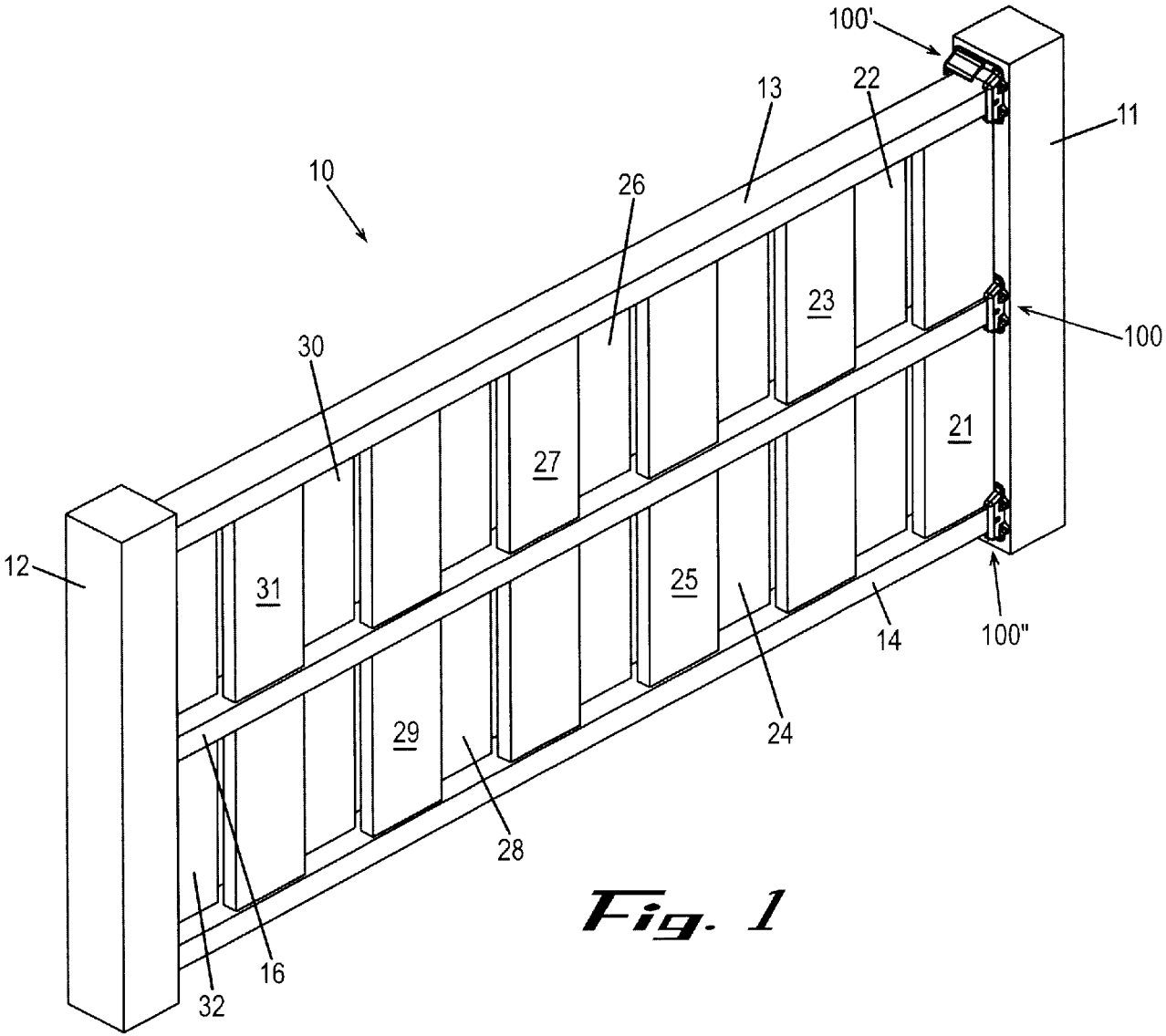
FIG. 1 is a perspective, schematic illustration of a modular fence system according to a preferred form of the invention, showing components of the fence system assembled and ready for installation.
Figure 2:
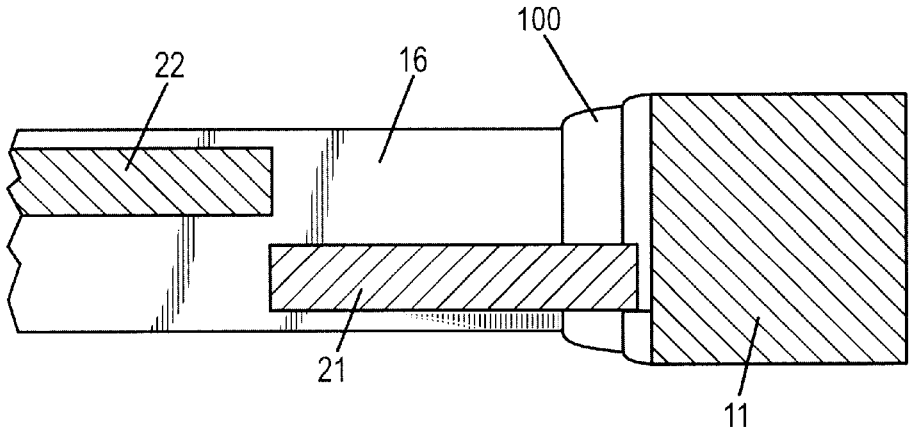
FIG. 2 is a schematic, sectional view of a portion of the modular fence system of FIG. 1.
Figure 3:
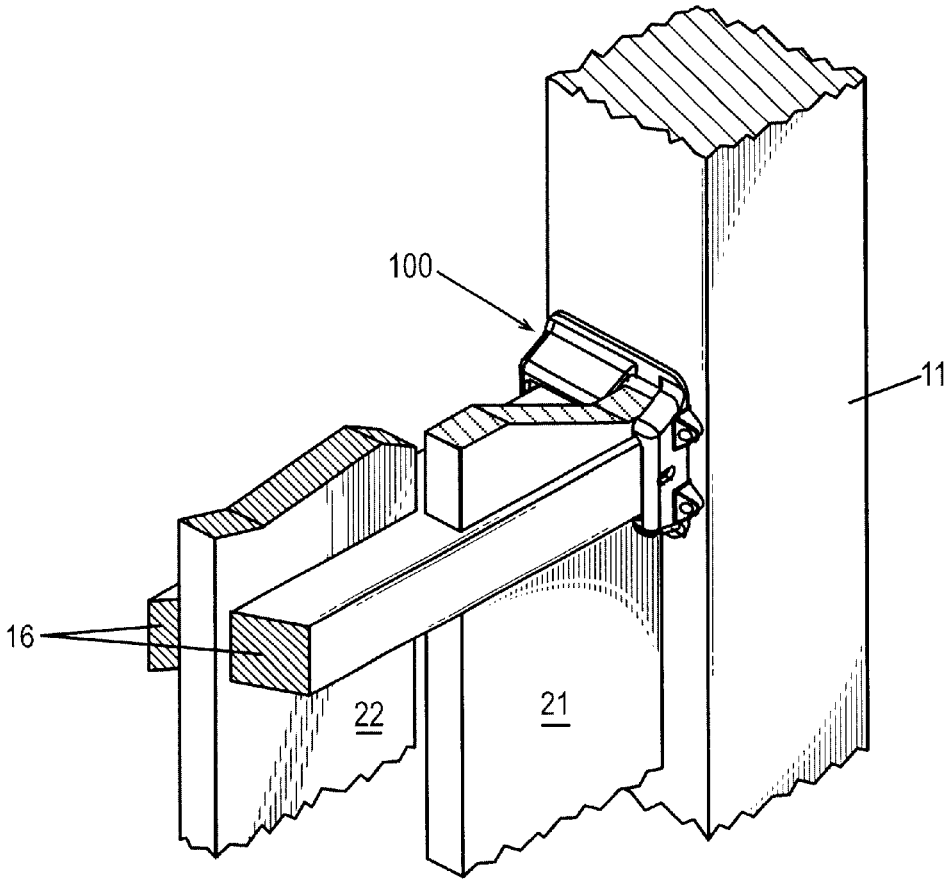
FIG. 3 is a schematic, perspective view of a portion of the modular fence system of FIG. 1, with some items cut away for clarity of illustration.

Referring now in detail to the drawing figures, wherein like reference numerals represent like parts throughout the several views, FIGS. 1–3 show a modular fence system 10 according to a preferred form of the invention. In fact, FIG. 1 depicts one complete section of fence, it being understood that as many of these sections as are needed can be strung together. The modular fence system 10 includes first and second upright posts 11, 12 spaced apart from one another and spanned by an upper rail 13, a lower rail 14 and an intermediate rail 16. Of course, where the fence system 10 is provided as a kit, each intermediate fence section can include one post and the second post can be provided by the adjacent fence section.

"The rails support and position alternating picket boards extending from the lower rail 14 to the upper rail 13. As shown in FIG. 1, the modular fence system section 10 includes a first front picket board 21, a first rear picket board 22, a second front picket board 23, a second rear picket board 24, and so on, through picket boards 25, 26, 27, 28, 29, 30, and 31, to a last picket board 32, with the front and rear picket boards lined up in front and rear rows and being closely adjacent to one another. The picket boards extend through correspondingly shaped openings formed through the intermediate rail 16 and into correspondingly shaped openings formed in the upper and lower rails 13, 14."

Preferably, the posts, rails, and picket boards are provided by rectangular tubing made of plastic (such as PVC). Alternatively, these components could be made from fiberglass, metal, wood, composites, and/or other materials, could be provided by tubing having a circular, polygonal, or other regular or irregular cross sectional shape, could be solid (as shown in FIG. 3), and/or could be composite construction with a wood core and a layered plastic cladding. The cladding can utilize a low-cost inner plastic material (it need not be weatherable) and a weatherable outer layer (such as PVC).

In a typical commercial embodiment, the posts 11, 12 could be nominally or actually 4×4 (nominal 4×4 wood posts have a cross section of approximately 3½ by 3½ inches) or nominally or actually 5×5, with walls having a thickness of about 0.13 inches. The picket boards could have a width of about 5.9 inches, with walls having a thickness of about 0.05 inches. The rails could be nominally 2×3 (approximately 1½ by 2½ inches), with top and bottom walls having a thickness of about 0.075 inches and side walls having a thickness of about 0.105 inches. The thinner top and bottom walls facilitate racking of the rails while the thicker side walls provide strength. Alternatively, the top, bottom and side walls of the rails can have a uniform thickness. Of course, other dimensions could be selected for the posts, rails, and picket boards, for a given application.

Figure 7:
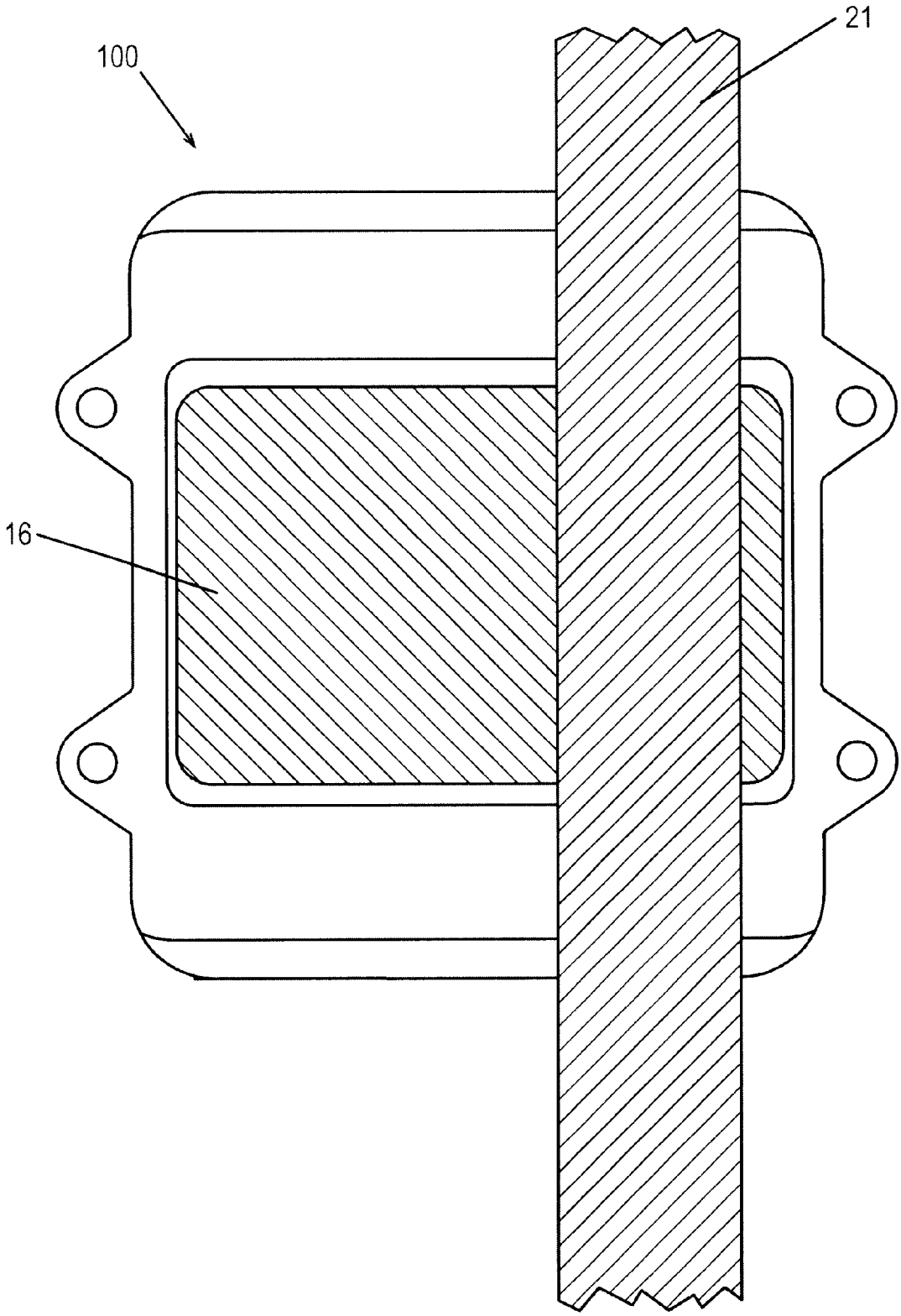
FIG. 7 is an elevation view of the fence bracket of FIG. 4, depicting a railing end inserted therein and a picket board edge inserted therein (both shown in section).

The rails are secured to the post 11 using plastic mounting brackets, such as brackets 100, 100', and 100" shown in FIG. 1. Alternatively, the brackets can be made of metal, fiberglass, wood, a composite, or another material. Similar mounting brackets are used to secure the rails to the post 12. As best seen in FIGS. 2, 3 and 7, the mounting brackets receive both an end of a rail and an edge of an upright picket board. For example, bracket 100 is mounted to post 11. The mounting bracket 100 receives an end of rail 16 therein. Note that the rail, however, has an upright picket board 21 extending upwardly therethrough in the vicinity of the bracket 100. To accommodate this without substantially offsetting the picket board 21 from the post 11, the mounting bracket is cut away (has openings extending through the side walls to allow the picket board to be brought rather closely adjacent (but it need not actually touch) the post 11. The details of the mounting brackets are discussed in greater detail immediately below.

FIGS. 4–7 show a bracket 100 according to a preferred form of the invention. The fence bracket 100 as depicted has a generally square overall footprint with four attachment ears 101–104 extending outwardly therefrom. Alternatively, the bracket can have another regular or irregular shape, such as a T-shape to generally conform to the shape of the bracket opening described below. The attachment ears include holes or apertures formed therethrough for receiving threaded fasteners for securing the bracket 100 to a post of a fence system. The fastener bores or holes are labeled 105–108. Of course, the holes can be provided in the body of the bracket, and/or other conventional fastening structures can be provided.

The bracket 100 includes a peripheral wall 110 arranged in a rectangular fashion to make the bracket rather box-like. The peripheral wall 110 includes first and second opposed side walls 111 and 112 and first and second opposed end walls 113 and 114. Side walls 111 and 112 are breached by generally rectangular opening portions 116 and 117, while end walls 113 and 114 are not so breached. The side walls and end walls extend up from a base surface indicated generally at 118 to an upper face indicated at 119. The side walls and end walls define a three dimensional opening 120 in the bracket, including a generally rectangular opening portion 121 in the face 119 intersecting with the rectangular opening portions 116 and 117 formed in the side walls 111 and 112. When viewed from the perspective of FIG. 5, the side walls and end walls define a generally T-shaped opening. This is more clearly seen in FIG. 6 in which the T-shaped opening 120 is shown in solid lines, while the overall shape of the bracket 100 is shown in dash lines. Of course, the brackets for the upper and lower rails need not have both opening portions 116 and 117, but alternatively can have only one of the opening portions where the picket boards extend through the bracket towards the intermediate rail but not through the bracket away therefrom.

Figure 4:
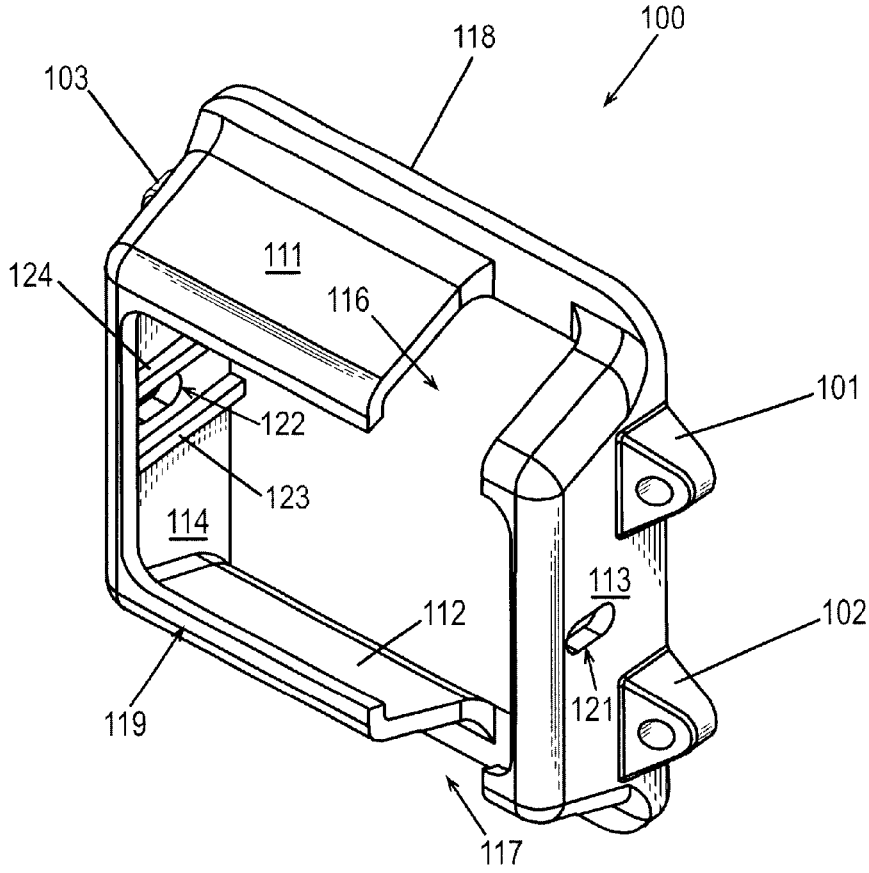
FIG. 4 is a perspective, schematic illustration of a fence bracket portion of the modular fence system of FIG. 1 according to a preferred form of the invention.
Figure 4A:
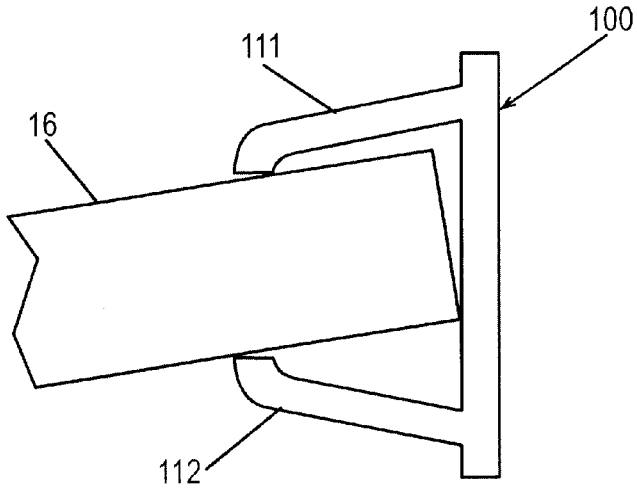
FIG. 4A is a side detail view of the bracket of FIG. 4, showing a rail inserted into the bracket with the rail racked at an angle.
Figure 5:
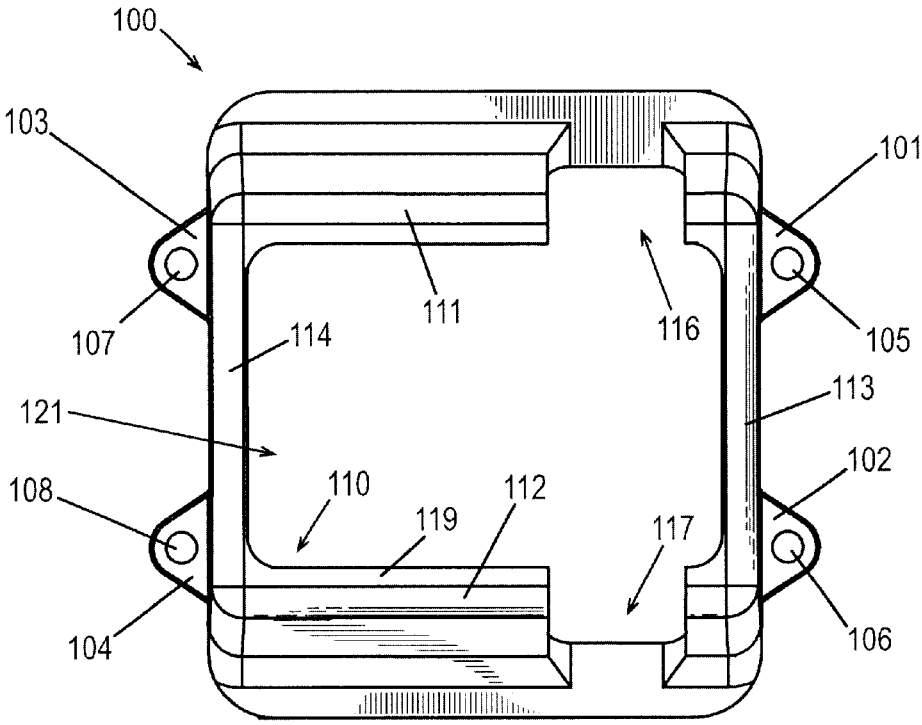
FIG. 5 is an elevation view of the fence bracket of FIG. 4.
Figure 6:
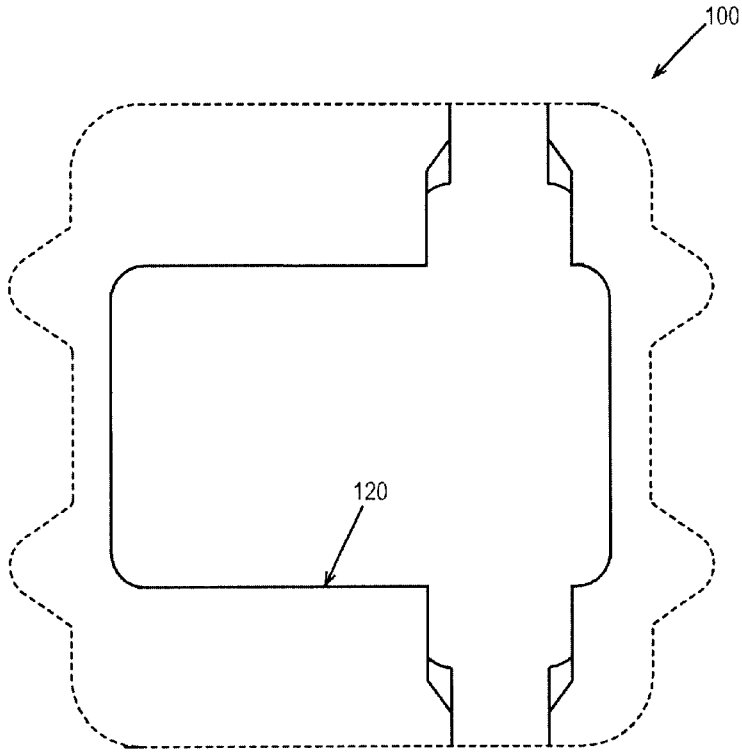
FIG. 6 is a schematic view of the fence bracket of FIG. 5, showing the overall outline of the periphery of the fence bracket in dash lines and showing an opening defined by the walls thereof in solid lines.

As best seen in FIGS. 4 and 5, side walls 111 and 112 can be slanted towards each other somewhat. This feature of slanting the side walls toward each other allows the brackets to accept the rails therein at an angle other than 90 degrees. This allows, for example, the fence system 10 to follow uneven terrain while still securely receiving the ends of the rails in the brackets 100. Likewise the end walls could be slanted toward each other to help the fence system follow a lateral curvilinear path. Alternatively or additionally, the interior of the bracket opening can be wider than the end of the opening at surface 119, for the same purpose. Thus, the slanted walls permit the bracket openings to receive the rail end portions therein when the posts are disposed generally vertically and the rails are disposed either perpendicularly or at another angle relative to the posts (see FIG. 4A).

End walls 113 and 114 define fastener openings 121 and 122 which are elongate for receiving threaded fasteners therethrough for securing a railing or picket, as the case may be, within the bracket. To strengthen the end walls 113 and 114 in the vicinity of these fastener holes, bolster rails, such as bolster rails 123 and 124, flank each of the fastener holes 121 and 122 and extend from the base 118 toward the upper face 119.

FIG. 7 shows a bracket 100 receiving a rail 16 and a picket board 21 therein. In FIG. 7, it is to be understood that the bracket would in turn be fastened to a post (unshown).

While the bracket described herein can be used for many types of fence systems, it is particularly well suited for use with alternating picket boards, i.e. in a shadowbox-type fence. In this regard, it can be appreciated that the openings in the side walls allow the upright picket boards to come nearly flush against the post so that the tight spacing maintained typically between adjacent upright picket boards in a fence section can be maintained between the end picket board and the post. Due to the design of the bracket as described herein, the identical bracket can be used on each end of the fence section and the bracket being rotated one way or another depending upon whether the picket board is towards the front of the fence or towards the back (FIG. 7 shows the picket board towards the right side of a post).

Figure 8:
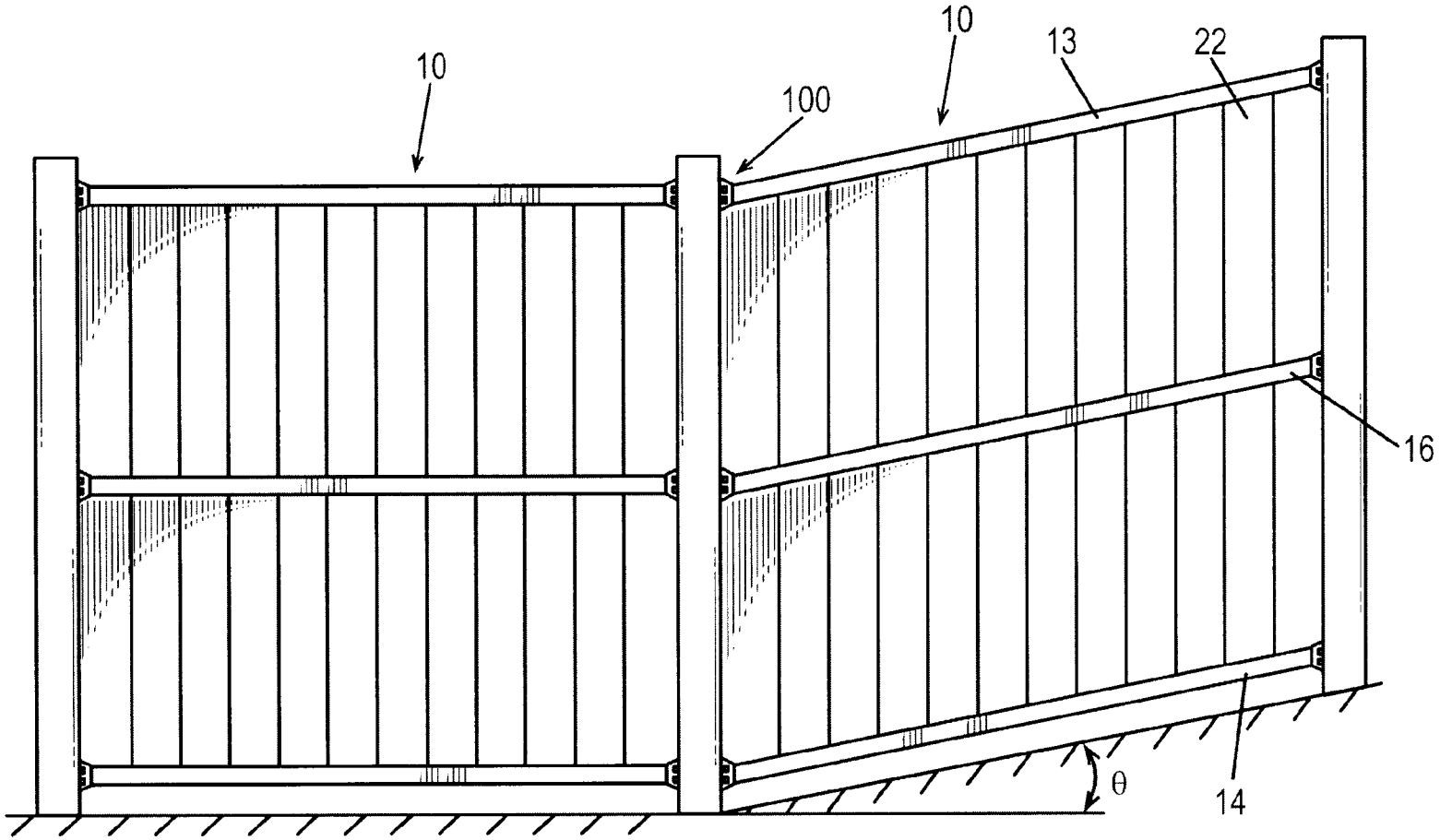
FIG. 8 is an elevation view of two of the fence systems of FIG. 1, showing one system or section on sloping ground with the picket boards generally vertical and the rails angled from horizontal.

Due to the unique design of the brackets and the rails, the fence system can most always be installed with the picket boards arranged generally vertically, whether the ground is flat (and the rails horizontal) or whether the ground is sloped (and the rails are at an angle). For example, FIG. 8 shows two modular fence systems 10, with one system or section installed on sloping ground at an angle θ relative to the horizontal. Having described the brackets in detail, the unique features of the rails will now be described.

Figure 9:
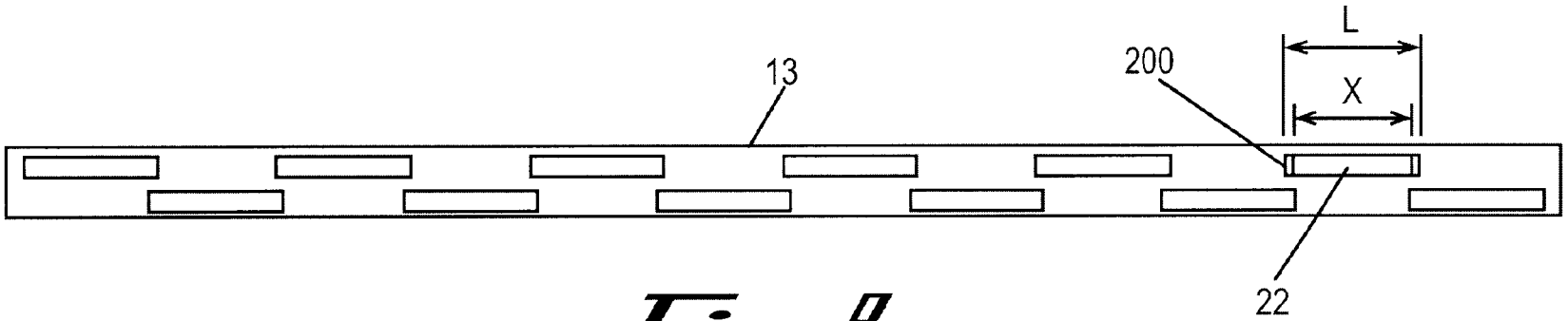
FIG. 9 is a bottom plan view of the first upper rail of FIG. 8, showing staggered openings in the rail for receiving the tops of the picket boards.
Figure 10:
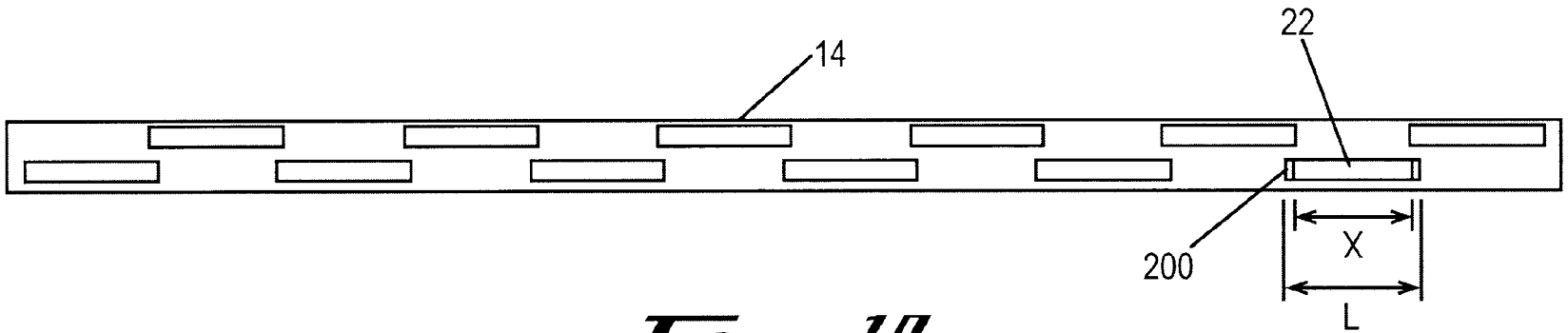
FIG. 10 is a top plan view of the second lower rail of FIG. 8, showing staggered openings in the rail for receiving the bottoms of the picket boards.

FIGS. 9 and 10 show the bottom of the first upper rail 13 and the top of the second lower rail 14, respectively. The rails have openings 200 that are staggered for receiving the bottoms of the picket boards. The openings 200 have a length (L) that is sufficiently greater than a width (x) of the picket boards (for example, picket board 22 shown in the figures) such that the picket boards can be received into the rail openings with the rails being disposed either horizontally or at an angle relative to horizontal and the picket boards maintained generally vertical. Because the openings are longer than the width of the picket boards, where adjacent picket boards are provided in close proximity to each other, the adjacent front and back openings will overlap. Likewise, the intermediate rail 16 has similar staggered openings, as described in more detail below.

Figure 11:
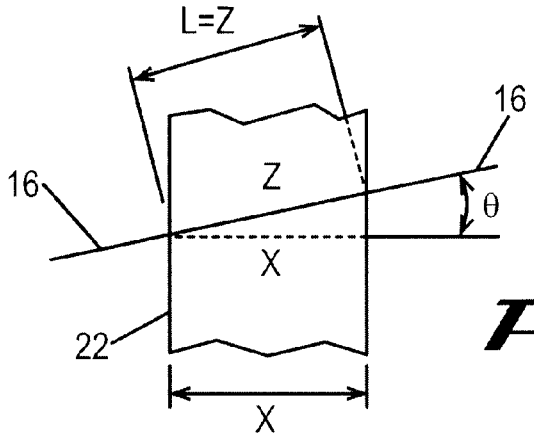
FIG. 11 is a schematic, elevation view of one of the picket boards and one of the intermediate rails of FIG. 8, showing the basic geometry used to determine the length of the rail openings.

FIG. 11 shows the basic geometry used to determine the length (L) of the rail openings 200. Using intermediate rail 16 and picket board 22 as an example, the length (L) of the openings 200 can be determined by the equation:

L=x (secant θ); wherein x=the width of the picket board; and

θ=the angle of the rail relative to horizontal.

The angle θ is selected as the preferred maximum angle of sloping ground (or other surface) for which the fence system can be used. For example, in a typical commercial embodiment, the angle θ could be selected to be about 10 degrees. Such a fence system can be used on any surface grade from flat up to about 10 degrees, rising or falling. It will be understood that, where the top and bottom ends of the picket rails are square, there is a maximum angle θ beyond which the picket board ends will not be situated entirely within the rail openings. For example, imagine FIG. 14 with the rails at several times the angle shown, assuming the length of the openings permitted such an angle. For the typical commercial embodiment, to keep the picket board ends in the openings, the maximum angle is about 12.5 degrees.

It will be further understood that the length (L) could be nominally larger than the length calculated to allow the picket to slide easily into the opening at the maximum angle θ. Therefore, as used herein, the term (and symbols for) "equals," "is," "are," and the like are intended to mean "equal or nominally larger than to allow the picket boards to fit into the openings."

Thus, the length (L) is equal to the hypotenuse (z) of the triangle defined by the picket width (x) and the angle θ. It will be understood that different widths of picket boards can be provided, and the length of the openings determined accordingly. Also, where desired, a single fence system can have two or more different sizes of picket boards and conforming rail openings, as may be desired in some situations.

Figure 12:
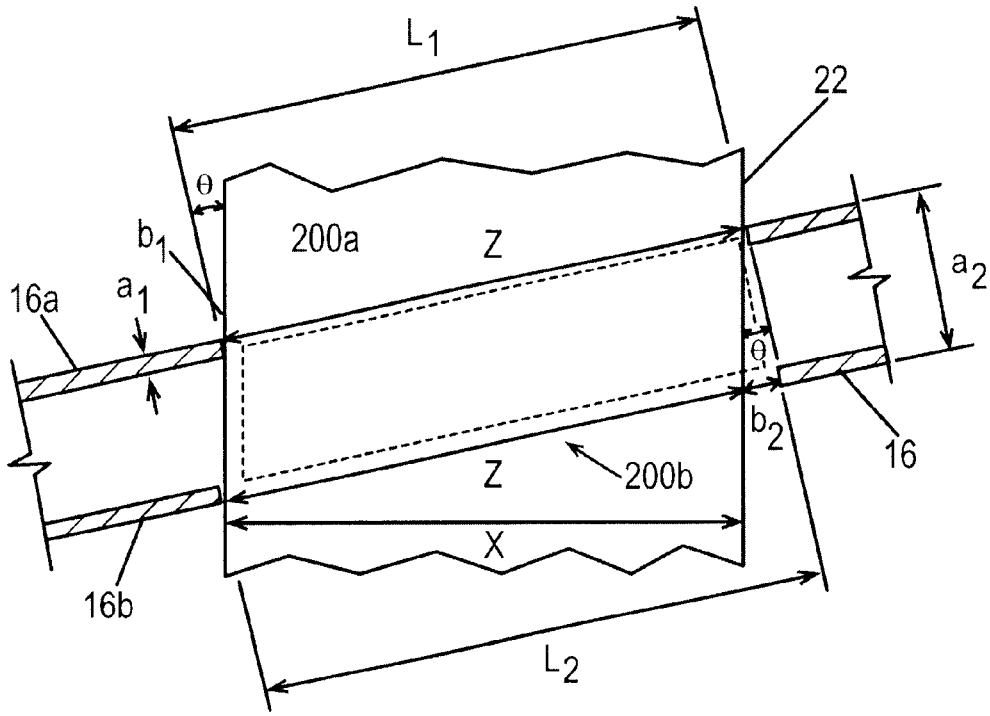
FIG. 12 is a schematic, elevation view similar to FIG. 11, showing the geometry used to determine the length of the rail openings where the rails have more than a nominal thickness.

The above equation assumes that the rail is negligibly thin. FIG. 12 shows the basic geometry with a tubular rail having more than a negligible thickness, and having a first wall 16*a* (for example, the top wall) with a first opening end 200*a* and a second wall 16*b* (for example, the bottom wall) with a second opening end 200*b*. In this case, the length of the first end 200*a* of the opening 200 can be determined by the equation:

L1=x (secant θ)+a1 (tangent θ); wherein

L1=the length of the first end of the opening;

x=the width of the picket board;

a1=the thickness of the first rail wall; and

θ=the angle of the rail relative to horizontal.

Thus, the length (L1) is equal to the hypotenuse (z) plus the segment (b1) of the triangle defined by the thickness of the first rail wall (a1) and the angle θ. In other words, the hypotenuse (z) is equal to "x (secant θ)" and the segment (b1) is equal to "a1 (tangent θ)." Because the thickness of the first and second rail walls of the tubular rail is typically insignificant relative to the thickness of the rail (i.e., the tubular rail can be about 2 inches thick with the top and bottom portions on the order of about 0.075 inches), the segment (b1) typically can be disregarded when determining the length of the opening.

Similarly, the length of the second end 200*b* of the opening 200 can be determined by the equation:

L2=x (secant θ)+a2 (tangent θ); wherein

L1=the length of the first end of the opening;

x=the width of the picket board;

a2=the thickness of the rail; and

θ=the angle of the rail relative to horizontal.

Thus, the length (L2) is equal to the hypotenuse (z) plus the segment (b2) of the triangle defined by the thickness of the rail (a2) and the angle θ. In other words, the hypotenuse (z) is equal to "x (secant θ)" and the segment (b2) is equal to "a2 (tangent θ)."

For example, in the typical commercial embodiment described above, the picket boards have a width of about 5.9 inches and the rails have a thickness of about 2 inches and a top and bottom wall thickness of about 0.075 inches, and the maximum angle θ of use is about 10 degrees. Thus, the openings of the upper rail and the lower rail, and the first opening end of the intermediate rail, will have a length of about 6.2 inches, and the second opening end of the intermediate rail will have a length of about 6.5 inches. In this manner, the second end 200*b* of the opening 200 is longer than the first end 200*a* by a distance of about the length of segment b2 (when disregarding the segment b1). Thereby, the opening 200 has the general shape of a trapezoid (as shown in broken lines). It will be understood that the opening can have a generally trapezoidal shape with two right angles and one angled side, as shown, for racking or angling the rails in one direction, or with no right angles and two angled sides so that the rails can be racked in either direction (though up to a lesser angle in either direction). Alternatively, the openings can have a trapezoidal shape that is inverted from that shown, a rectangular shape, or another regular or irregular shape, as may be desired.

Figure 13:
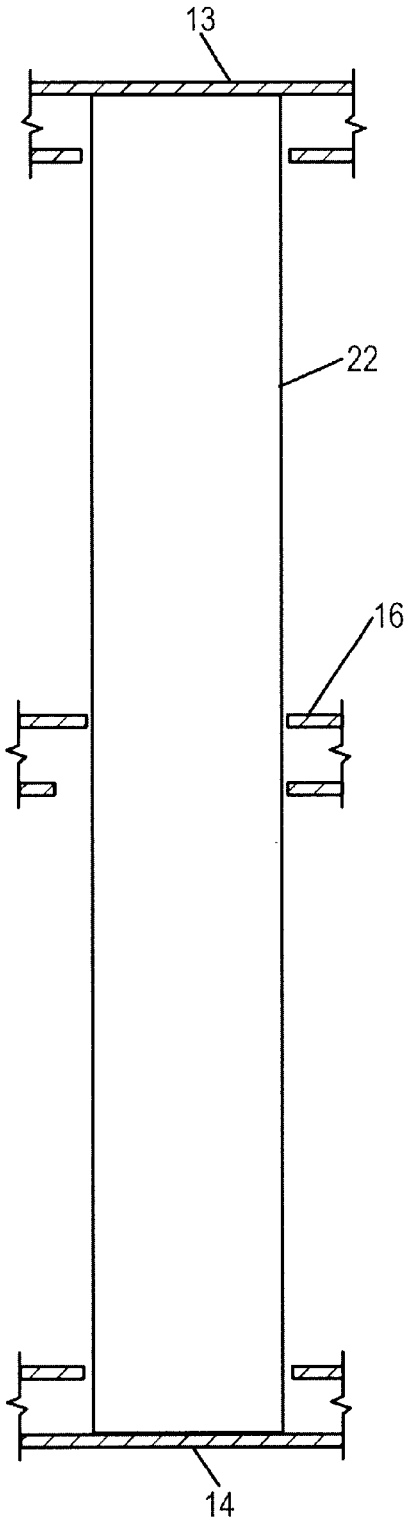
FIG. 13 is a side elevation view of a portion of the fence system of FIG. 8, showing the rails in a generally horizontal position.
Figure 14:
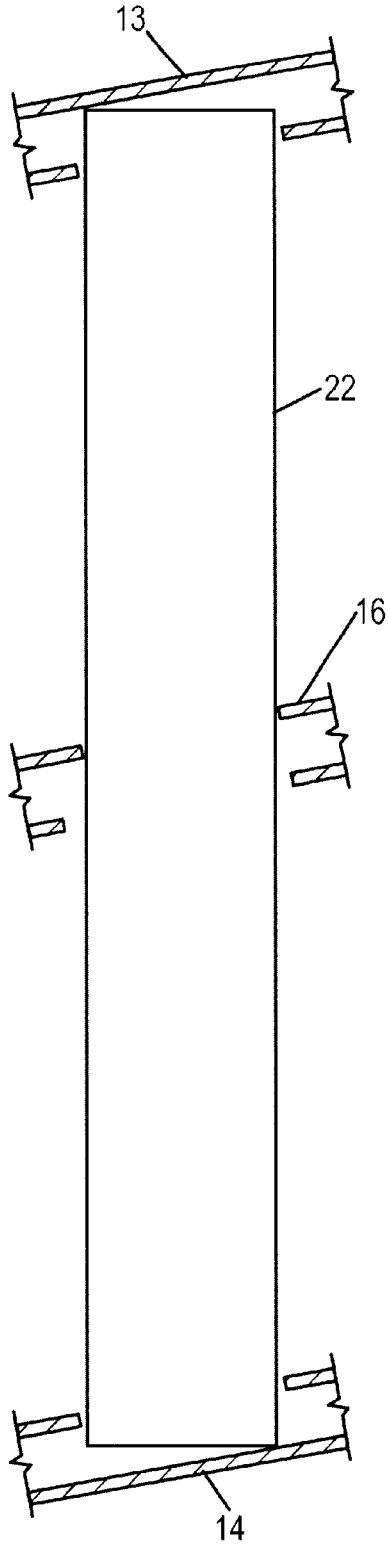
FIG. 14 is a side elevation view of FIG. 13, showing the rails racked at an angle.

FIGS. 13 and 14 show how the openings permit the rails to be positioned generally horizontally or racked at an angle to horizontal, as may be desired. FIG. 13 shows picket board 22 in a generally vertical position and the rails 13, 14, 16 in a generally horizontal position. FIG. 14 shows the rails 13, 14, 16 racked at an angle relative to horizontal while the picket board 22 is maintained in a generally vertical position.

Figure 14A:
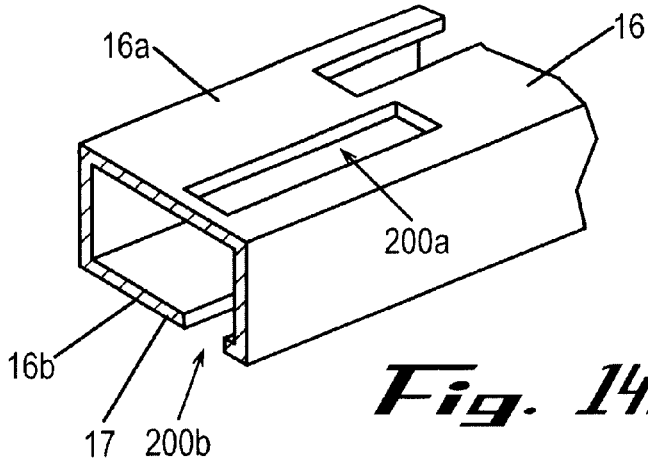
FIG. 14A is a perspective view of the intermediate rail of FIG. 8, showing the second opening portion extending through the end of the rail.

FIG. 14A shows the first or last opening 200 in the intermediate rail 16 at an end 17 of the rail. Because this opening is at the end 17 of the rail 16, the lower end 200*b* of the opening 200 extends through the end of the rail in order to permit the first or last picket 21 or 32 to extend beyond the end of the rail and into the opening 120 of the bracket 100 when the rails are racked at an angle. Accordingly, this opening will not have the same trapezoidal shape as the other openings. The length of the lower opening end 200*b* will, then, be less than the other lower opening ends of the intermediate rail 16.

Because the openings are longer than the width of the picket boards, a small gap results between the picket boards and the rails when the rails are positioned horizontally or at less than the maximum angle θ. In order to hold the picket boards in a generally equally spaced configuration, there can be provided a means for securing the picket boards relative to the rails. Examples of such securement means are shown by FIGS. 15–19.

Figure 15:
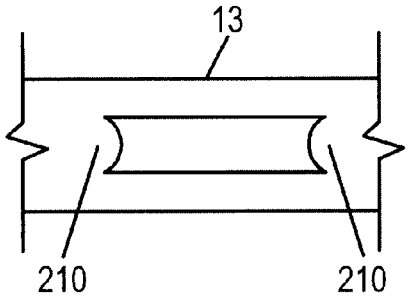
FIG. 15 is a plan detail view of one of the rails of FIG. 8, showing tabs that contact the pickets to fill the gap between the rail and the picket.
Figure 16:
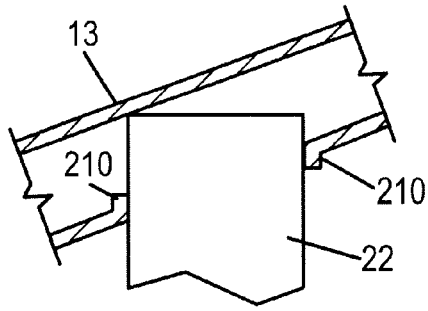
FIG. 16 is a side detail view of the rail of FIG. 15, showing the tabs deflected with the rail racked at an angle.
Figure 17:
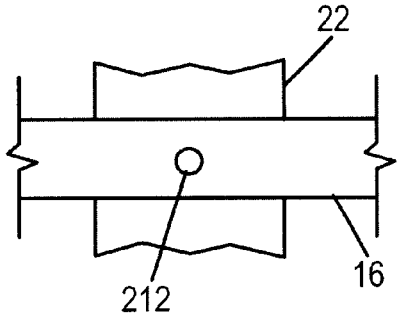
FIG. 17 is a side detail view of one of the rails of FIG. 8, showing a pin that secures the pickets in place.
Figure 18:
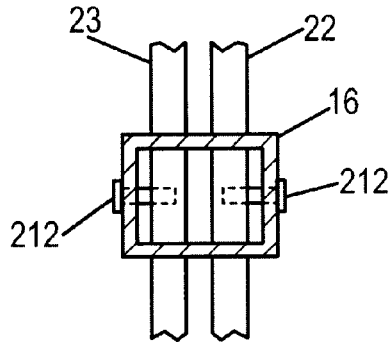
FIG. 18 is an end detail view of the rail of FIG. 17, showing the pin though the rail and the pickets.
Figure 19:
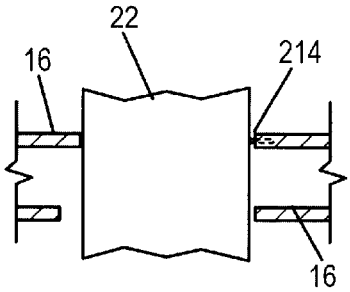
FIG. 19 is a side detail view of one of the rails of FIG. 8, showing an extendable member that fills the gap.
Figure 20:
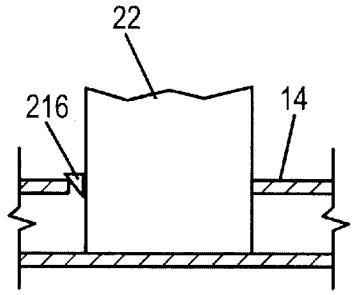
FIG. 20 is a side detail view of one of the rails of FIG. 8, showing a shim inserted into and filling the gap.

FIGS. 15 and 16 show tabs 210 of the rail 13 which fill the gap when the pickets are positioned vertically. When the rails are racked at an angle, the tabs 210 are deflected (or can be removed, entirely or in segments) to remain in contact with the pickets. Two opposing tabs can be provided (having a curved shaped, as shown, or a rectangular or other regular or irregular shape) or, alternatively, one larger tab can be provided. The tabs can be integrally formed with the rail, or provided by separate members attached thereto, made of a generally rigid or elastic material. FIGS. 17 and 18 show a pin that can be inserted into alignable holes in the rail and the picket. The pin 212 can be provided by a threaded screw, a dowel, a plug, or the like. FIG. 19 shows an extendable member 214 such as a threaded screw, a spring-loaded member, or the like that can be extended or retracted to fill the gap. FIG. 20 shows a shim 216 that can be inserted into the gap, as desired, to fill the gap. It will be understood that other structures known in the art can be suitably provided for securing the pickets in place.

Figure 21:
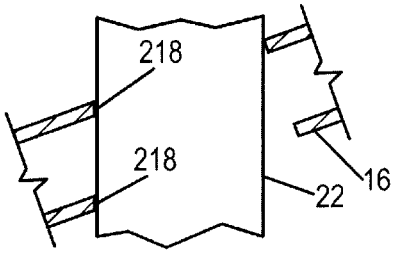
FIG. 21 is a side detail view of one of the rails of FIG. 8, showing angled inner walls forming the opening.
Figure 22:
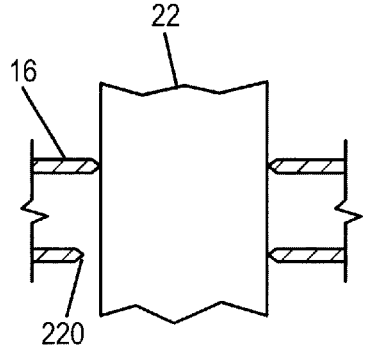
FIG. 22 is a side detail view of one of the rails of FIG. 8, showing tapered, pointed inner walls forming the opening.
Figure 23:
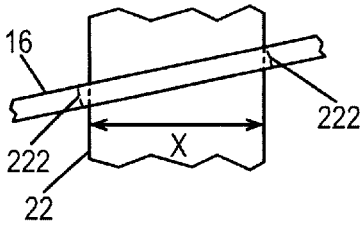
FIG. 23 is a side detail view of an alternative solid intermediate rail, showing parallel inner walls forming the opening.
Figure 24:
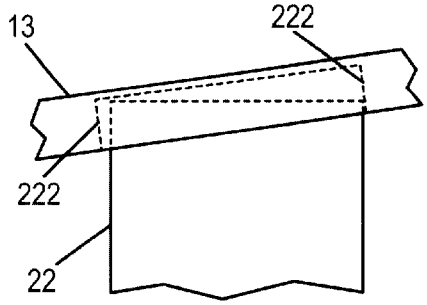
FIG. 24 is a side detail view of an alternative solid upper rail, showing parallel inner walls forming the opening.
Figure 25:
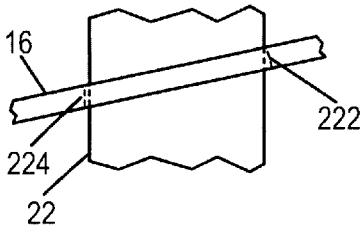
FIG. 25 is a side detail view of an alternative solid intermediate rail, showing angled inner walls forming the opening.
Figure 26:
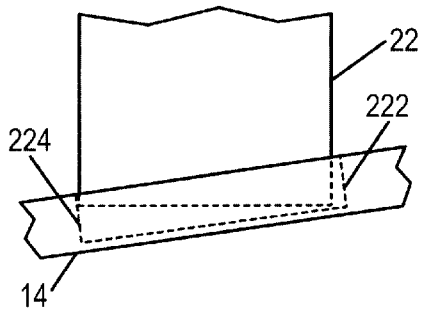
FIG. 26 is a side detail view of an alternative solid lower rail, showing angled inner walls forming the opening.

FIG. 21 shows an alternative embodiment of the tubular rails, with the first and/or second rail portions having one or more angled inner walls 218. FIG. 22 shows another alternative embodiment, with the first and/or second rail portions having tapered, generally pointed inner walls 220. It will be understood that the inner walls can be rounded, have large heads and thin necks, or have other shapes, as may be desired. FIGS. 23 and 24 show another embodiment of the fence system, with solid rails having parallel inner walls 222. FIGS. 25 and 26 show yet another embodiment with solid rails, with one inner wall 224 angled relative to the other inner wall 222 for forming a trapezoidal shaped opening. The lengths of such openings in solid rails can be determined by the same equations above for tubular rails, except that for the upper and lower rails, the segment (b) is based on the depth of the opening into the rail.

In another alternative embodiment, the openings can extend only partially through a solid intermediate rail, with socket openings in both the top and bottom sides of the intermediate rail, and with two (or more) picket board sections provided (one extending between the intermediate rail and the upper rail and one extending between the intermediate rail and the lower rail). Furthermore, the rails can be provided as unitary members or in sections that are connected together.

Also, another alternative embodiment provides the openings in the upper rail and/or the lower rail extending all the way through the rails, and the picket boards extending all the way through the openings to above the upper rail and/or to below the lower rail. This is similar to conventional picket fencing where the picket boards extend above the upper rail and below the lower rail (though not through openings in the rails). This arrangement of the openings can be advantageous in some applications because, with the rails closer together, only two rails are needed to hold the pickets in place. In this configuration, the upper and/or lower rails (and any intermediate rails) have openings with the generally trapezoidal shape described above for the intermediate rail.

It will be understood that the various components of the above-described modular fence system 10 can be provided as a kit for assembly on-site, with dimensions selected for providing the desired height, length, and width of the fence. Each kit can include the appropriate number of components for assembling one section of fence, or for assembling multiple sections, as may be desired. Because of the innovative brackets and rails, the same kit can be used to assemble a fence section for use on flat ground or on sloping ground (or other surface). Thus, one type of kit can be manufactured and stocked for use in most any application.

Alternatively, the kit can be provided with only the rails and brackets for assembly with separately obtained picket boards and posts. In another alternative, the picket boards, posts, rails, and brackets of the fence system 10 can be pre-assembled as ready-to-install units.

Having thus described the preferred forms of the present invention, those skilled in the art will additionally recognize that the within disclosures are exemplary only, and that various other alternatives, adaptations, and modifications may be made within the spirit and scope of the present invention as set forth in the following claims.

What is claimed is:

1. A modular fence system comprising:

a pair of upright posts;

a first upper rail, a second lower rail, and a third intermediate rail, each of the rails having a plurality of openings defined therein; and a plurality of upright picket boards extending from the second lower rail to the third intermediate rail to the first upper rail and received into the openings in the rails, wherein each of the rail openings has a length sufficiently greater than a width of the picket boards such that the picket boards can be received into the rail openings with the rails being disposed either horizontally or at an angle relative to horizontal and the picket boards maintained generally vertical, wherein each of the openings in the intermediate rail has a generally trapezoidal shape defined in part by a first opening end and a second opening end that is longer than the first opening end by a distance of about (a) (tangent θ) where (a) is the thickness of the rail and (θ) is the maximum angle of the rail relative to horizontal, wherein the openings in the intermediate rail include a first or last opening at an end portion of the rail and the second end of the first or last opening extends through the end portion of the rail; and a plurality of mounting brackets secured to the posts to receive and secure end portions of the rails therein, each of the brackets also being adapted to receive an edge of one of the upright picket boards therein to secure the edge of the upright picket board near one of the upright posts, wherein the brackets each include peripheral walls defining an opening, wherein the bracket opening is generally T-shaped and formed by a first generally rectangular opening portion and a second generally rectangular opening portion, the first generally rectangular opening portion being about twice as wide as the second generally rectangular opening portion, wherein the bracket opening extends through the peripheral wall in places to allow the edge of the upright picket board to extend out of the bracket on opposite sides.

2. The modular fence system of claim 1 wherein the mounting brackets on one of the posts are identical to the mounting brackets on the other of the posts, with only the orientation of the brackets differing.

3. The modular fence system of claim 1 wherein the peripheral walls of the brackets includes at least two wails that lean toward each other to form an inversely tapered interior so that the rail end portions can be received into the bracket openings when the posts are disposed generally vertically and the rails are disposed either perpendicularly or at another angle relative to the posts.

4. The modular fence system of claim 1 further comprising means for securing the picket boards relative to the rails.

5. The modular fence system of claim 1 wherein the intermediate rail is hollow and has a top wall, a bottom wall, and two side walls, with the top and bottom walls having a thickness that is less than a thickness of the side walls.

6. The modular fence system of claim 1 wherein adjacent ones of the upright picket boards are staggered front and back, and adjacent ones of the rail openings are staggered front and back to receive the staggered picket boards, with the adjacent staggered front and back rail openings overlapping each other.

7. The modular fence system of claim 1 wherein upright posts, the rails, the upright picket boards, and the brackets are at least partially made from plastic.

8. A modular shadow box style fence system comprising:

a first upper rail and a second lower rail;

a plurality of upright picket boards positionable extending from the second lower rail to the first upper rail and alternating front and back; and a plurality of mounting brackets each having peripheral walls defining an opening with a rail opening portion adapted to receive and secure end portions of the rails therein and with a picket opening portion adapted to at the same time receive an edge of one of the upright picket boards therein, wherein said picket opening portion is positioned off-center of said rail opening portion so that the picket received in said off-center picket opening portion can be a front or back one.

9. A modular fence system comprising:

a first upper rail, a second lower rail, and a third intermediate rail positionable between the first upper rail and the second lower rail;

a plurality of upright picket boards positionable extending from the second lower rail to the first upper rail, the third intermediate rail having a plurality of openings formed therethrough for receiving the upright picket boards therethrough; and a plurality of mounting brackets positionable to receive and secure end portions of the rails therein, each of the brackets also being adapted to receive an edge of one of the upright picket boards therein.

10. A modular fence system comprising:

a first upper rail and a second lower rail;

a plurality of upright picket boards positionable extending from the second lower rail to the first upper rail, wherein the first upper rail and the second lower rail each have a plurality of openings formed therein for receiving upper and lower ends of the upright picket boards therein; and a plurality of mounting brackets positionable to receive and secure end portions of the rails therein, each of the brackets also being adapted to receive an edge of one of the upright picket boards therein.

11. The modular fence system of claim 10 wherein the rail openings have a length sufficiently greater than a width of the picket boards such that the picket boards can be received into the rail openings with the rails being disposed either horizontally or at an angle relative to horizontal, and the picket boards maintained generally vertical.

12. The modular fence system of claim 8 further comprising one or more posts, wherein the mounting brackets are securable to the posts and the mounting brackets are securable to the edges of the upright picket boards near the upright posts.

13. The modular fence system of claim 8 wherein the bracket opening is generally T-shaped.

14. A modular fence system comprising:

a first upper rail and a second lower rail;

a plurality of upright picket boards positionable extending from the second lower rail to the first upper rail; and a plurality of mounting brackets each including peripheral walls defining a generally T-shaped opening adapted to receive and secure end portions of the rails therein and to also receive an edge of one of the upright picket boards therein, wherein the generally T-shaped opening includes a first generally rectangular opening portion and a second generally rectangular opening portion.

15. The modular fence system of claim 14 wherein the first generally rectangular opening portion is about twice as wide as the second generally rectangular opening portion.

16. The modular fence system of claim 13 wherein the bracket opening extends through the peripheral wall in places to allow the edge of the upright picket board to extend out of the bracket on opposite sides.

17. The modular fence system of claim 13 wherein the peripheral wall of the brackets includes at least two walls that lean toward each other to form an inversely tapered interior.

18. A modular fence system comprising:

a first upper rail and a second lower rail;

a plurality of upright picket boards positionable extending from the second lower rail to the first upper rail; and a plurality of mounting brackets each including peripheral walls defining a generally T-shaped opening adapted to receive and secure end portions of the rails therein and to also receive an edge of one of the upright picket boards therein, wherein an interior of the bracket opening is wider than an end of the opening at a front surface of the bracket.

19. A modular fence system comprising:

at least two rails, each one of the rails having a plurality of openings defined therein; and a plurality of upright picket boards each positionable extending between the rails and through the corresponding openings of at least one of the rails, wherein each rail opening receives only one of the picket boards, wherein each of the rail openings has a length sufficiently greater than a width of the picket boards such that the picket boards can be received into the rail openings with the rails being disposed either horizontally or at an angle relative to horizontal, and the picket boards maintained generally vertical.

20. A modular fence system comprising:

at least two rails each having a plurality of openings defined therein; and a plurality of upright picket boards each positionable extending between the rails and through the corresponding openings of at least one of the rails, wherein each of the openings in the rail through which the picket boards extend has a first opening end and a second opening end, with the second opening end longer than the first opening end, and wherein each of the rail openings has a length sufficiently greater than a width of the picket boards, such that the picket boards can be received into the rail openings with the rails being disposed either horizontally or at an angle relative to horizontal and the picket boards maintained generally vertical.

21. The modular fence system of claim 20 wherein (a) is a thickness of the rail and (θ) is the maximum angle of the rail relative to horizontal, and wherein the second opening end is longer than the first opening end by a distance of about (a) (tangent θ).

22. The modular fence system of claim 20 wherein the openings in the rail through which the picket boards extend have a generally trapezoidal shape.

23. The modular fence system of claim 20 wherein the openings in the rail through which the picket boards extend include a first or last opening at an end portion of the rail, and the second end of the first or last opening extends through the end portion of the rail.

24. The modular fence system of claim 19 further comprising means for securing the picket boards relative to the rails.

25. A modular fence system comprising:

at least two rails each having a plurality of openings defined therein; and a plurality of upright picket boards each positionable extending between the rails and through the corresponding openings of at least one of the rails, wherein each of the rail openings has a length sufficiently greater than a width of the picket boards such that the picket boards can be received into the rail openings with the rails being disposed either horizontally or at an angle relative to horizontal, and the picket boards maintained generally vertical;

wherein the rail through which the picket boards extend is hollow and has a top wall, a bottom wall, and two side walls, with the top and bottom walls having a thickness that is less than a thickness of the side walls.

26. The modular fence system of claim 19 further comprising a plurality of mounting brackets each positionable to receive and secure end portions of the rails therein, each of the brackets having peripheral walls defining an opening, wherein the peripheral walls of each of the brackets includes at least two walls that lean toward each other to form an inversely tapered interior so that the rail end portions can be received into the bracket openings when the posts are disposed generally vertically and the rails are disposed either perpendicularly or at another angle relative to the posts.

27. The modular fence system of claim 26, further comprising a pair of upright posts, wherein each of the brackets is adapted to receive an edge of one of the upright picket boards therein for securing the edge of the upright picket board near one of the upright posts.

28. The modular fence system of claim 26 wherein each of the bracket openings are generally T-shaped, are formed by a first generally rectangular opening portion and a second generally rectangular opening portion, and extend through the peripheral wall in places to allow the edge of the upright picket board to extend out of the bracket on opposite sides.

* * * * *